US006855356B2

(12) United States Patent
Sugiyama et al.

(10) Patent No.: US 6,855,356 B2
(45) Date of Patent: Feb. 15, 2005

(54) PACKAGING BODY FOR HEATING PROCESSING

(75) Inventors: Takuji Sugiyama, Shizuoka (JP); Daisuke Uratani, Tokyo (JP); Tomohito Hayama, Shizuoka (JP); Masafumi Oishi, Shimizu (JP); Souichirou Katayama, Tokyo (JP); Kazuo Ariyoshi, Tokyo (JP); Tetsurou Kawamoto, Shizuoka (JP)

(73) Assignee: Sun A. Kaken Co., Ltd., Tokyo (JP)

( * ) Notice: Subject to any disclaimer, the term of this patent is extended or adjusted under 35 U.S.C. 154(b) by 234 days.

(21) Appl. No.: 09/935,737

(22) Filed: Aug. 24, 2001

(65) Prior Publication Data

US 2002/0187225 A1 Dec. 12, 2002

(30) Foreign Application Priority Data

Apr. 23, 2001 (JP) ..... 2001-123696
Jun. 27, 2001 (JP) ..... 2001-193847

(51) Int. Cl.[7] ..... B65D 33/01

(52) U.S. Cl. ..... 426/113; 426/118; 383/103; 219/735

(58) Field of Search ..... 219/735; 426/106, 426/112–114, 118; 383/100, 103

(56) References Cited

U.S. PATENT DOCUMENTS 4,358,466 A * 11/1982 Stevenson ..... 426/106
5,171,950 A * 12/1992 Brauner et al. ..... 219/727
5,655,842 A * 8/1997 Hagino ..... 383/101
5,928,553 A * 7/1999 Toshima et al. ..... 219/725
6,582,123 B1 * 6/2003 Tang ..... 383/100

* cited by examiner

*Primary Examiner*—Drew Becker
(74) *Attorney, Agent, or Firm*—Manabu Kanesaka

(57) ABSTRACT

A packaging body for heat processing a material retained therein is basically formed of a plastic base material having side joining sections, and end sides. The side joining sections and end sides are superposed and connected together to form a bag for filling the material. A sealant layer is deposited on at least one of the end sides to connect the end sides together through the sealant layer to thereby form a vapor communication joining section at the end sides. The sealant layer has a peeling off property from 0 to 1,200 gf/15 mm at 90° C. and a peeling off property of equal to or more than 3 kgf/15 mm at a room temperature. Thus, only when the packaging body is heated more than 90° C., the vapor communication joining section is only opened to release pressure inside the packaging body.

6 Claims, 12 Drawing Sheets

PACKAGING BODY FOR HEATING PROCESSING

BACKGROUND OF THE INVENTION

1. Field of the Invention

The present invention relates to a packaging body for heating processing capable of preventing from bursting the packaging body by the internal rising pressure due to heating as well as the contents of food or the like can be cooked by heating as it is packaged in a packaging body filled with food or the like.

2. Description of the Related Art

Conventionally, many kinds of packaged foods which are already cooked or half-cooked, filled in a plastic packaging bag having heat resistance and cooked by heating using a microwave oven immediately before eating are provided in the market.

Then, when these packaged foods are heated by a microwave oven, the internal pressure rises by thermal expansion of water evaporation of the internal bag and internal air, then at last, the bag bursts, the contents are scattered and the internal of the microwave oven is polluted, therefore, some sort of means are taken to these bags in order to prevent the occurrence of the foregoing defaults.

For example, when the foregoing internal pressure rises to more than a certain level, a vapor communication means by which one portion of a heat seal is peeled off so as to release the pressure is known.

However, surrounding heat seal portions for fabricating a bag are joined together with a high heat seal strength in order to tightly and securely seal and package the contents without easily being peeled off. On the other hand, the foregoing vapor communication heat seal portion is configured so that it is comparatively easily peeled off by the internal pressure generated during the heat-cooking process. Thus, in the heat seal portions, both heat seal strengths are differently set respectively, that is, the heat seal portion which allows the vapor to eject outwardly by the internal bag pressure is fabricated as a portion having a weak heat seal strength than those of the surrounding heat seal portions for fabricating a bag.

Therefore, at the time when the bag is fabricated or filled with the contents and packaged, in order to set the foregoing different heat seat strengths, the configuration of the foregoing vapor communication heat seal portion is formed by using a complex polyolefinic resin or the like for a sealant layer which is to be an easy-open-film as a plastic film base material of the bag.

Due to the work, the configuration of the bag has been too complex and troublesome, and in addition, the manufacturing cost has been raised at the time when a bag is fabricated or filled with the contents and tightly packaged, thereby not being easily capable of providing packaged foods or the like to the market at a lower cost.

SUMMARY OF THE INVENTION

The present invention has been made in order to solve the above-mentioned problems, and an object of the present invention is to provide a packaging body for heating processing which is capable of easily fabricating a bag or filling the contents and tightly sealing and packaging and manufacturing a packaged food or the like at a lower cost as well as the relevant vapor communication joining section is located on the upper surface side of the packaging body at the time of heating processing of the contents, and the burst of the packaging body at the time of heat-cooking can be prevented by the packaging body having a seal having an easily opening seal property which makes the pressure escape to the external, for example, when the internal pressure of the foregoing packaging body rises by heat from a microwave oven or the like. The foregoing packaging body for heating processing in which a vapor communication joining section in a rafter roof shape is provided at one location of these heat seals as well as identical surface sides thereof are contacted with each other through a plastic film and a bag is fabricated in a rectangular shape with a heat seal, in a packaging body in which the contents for heating processing is tightly sealed and packaged within the bag. The foregoing plastic film is a film whose entire joining surface is highly dependent on the temperature, a vapor communication joining section is formed so as to be parallel to the longitudinal direction of the rectangular packaging body, and under the usual condition, the packaging body does not have the easily opening seal property, but has the sufficient protective strength, that is, equal to or more than 3 kgf/15 mm of heat seal strength for the contents.

Means of the present invention for achieving the foregoing purpose exists, in a configuration such that, in a packaging body for heating processing in which identical surface sides of a plastic film are contacted with each other to form a bag in a rectangular shape by heat seals, and a vapor communication joining section in a rafter roof shape is provided at one location of these heat seals, whereby the contents for heating processing is tightly sealed and packaged within the fabricated bag, the foregoing film is a film whose entire joining surface is highly dependent on the temperature, the foregoing vapor communication joining section is formed so as to be parallel to the longitudinal direction of a packaging body in a rectangular shape, and the vapor communication joining section is a seal having an easily opening seal property which is located on the upper surface side of the packaging body at the time of heating processing of the contents and makes the pressure escape to the external when the internal pressure of the packaging body rises by heating.

Then, another means of the present invention for achieving the foregoing purpose exists in a configuration of the packaging body for heating processing such that, in a packaging body for heating processing in which identical surface sides of a plastic film are contacted with each other to form a bag by heat seals, and a vapor communication joining section in a rafter roof shape is provided at one location of these heat seals, whereby the contents for heating processing is tightly sealed and packaged within fabricated bag thereof, the foregoing vapor communication joining section has a film whose dependency on the temperature is high intervened between the foregoing plastic films, and the relevant vapor communication joining section is a seal having an easily opening seal property which is located on the upper surface side of the foregoing packaging body at the time of heating processing of the contents, and makes the pressure escape to the external when the internal pressure of the foregoing packaging body rises by heating.

The force of peeling off of the seal having an easily opening seal property during the usual condition is equal to or more than 3 kg f/15 mm, and the force of peeling off at the time of heating at 90° C. ranges from 0 to 1200 g f/15 mm.

A film whose dependency on the temperature is high in the vapor communication joining section is a tape inserted between the plastic films.

BRIEF DESCRIPTION OF THE DRAWINGS

The accompanying drawings, which are incorporated in and constitute a part of the specification, illustrate presently preferred embodiment of the invention, and together with the general description given above and the detailed description of the preferred embodiment given below, serve to explain the principles of the invention, wherein.

DESCRIPTION OF PREFERRED EMBODIMENT

EXAMPLES

Figure 1:
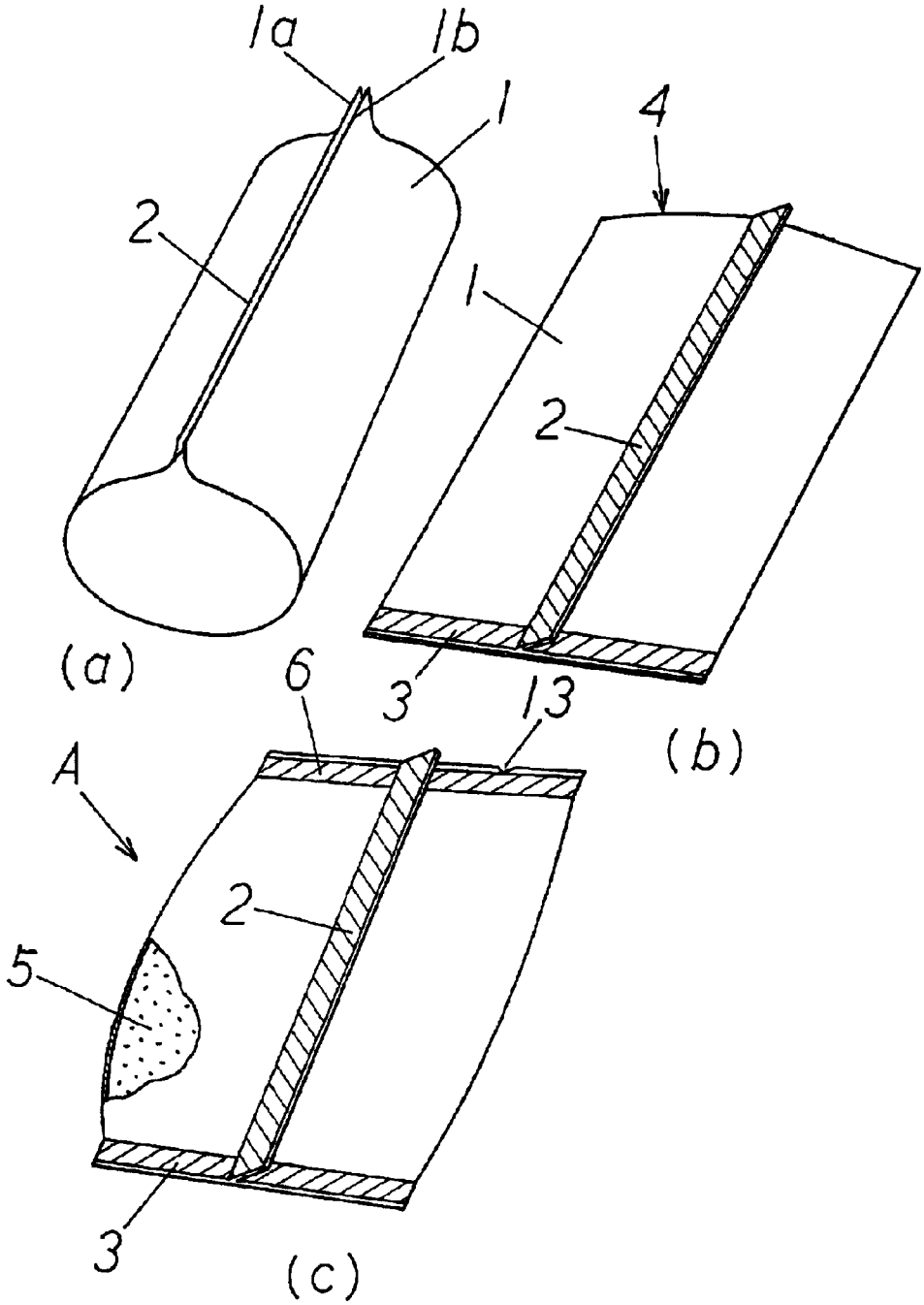
FIG. 1 is a perspective view showing manufacturing steps of a packaging body for heating processing of the first example according to the present invention.

Next, an example for carrying out of a packaging body for heating processing of the present invention will be described with reference to the drawings below.

In FIG. 1 through FIG. 5 and in FIG. 9 through FIG. 12, the reference character A denotes a packaging body for heating processing, which contains a product used by giving the predetermined heating to the inside, and to which heating processing is performed by a heating means such as a microwave oven and the contents are taken out by tearing one portion thereof appropriately at the time of using it.

As for the form of this packaging body A, an optional form such as a three sided seal bag, a four sided seal bag, an inflation bag, a rafter roof type flat bag, a rafter roof type gazette and the like can be selected.

Moreover, although it is based on the assumption that a packaging body is automatically filled with the contents while a bag is fabricated, even if it is a previously fabricated bag, it can be similarly used.

Figure 2:
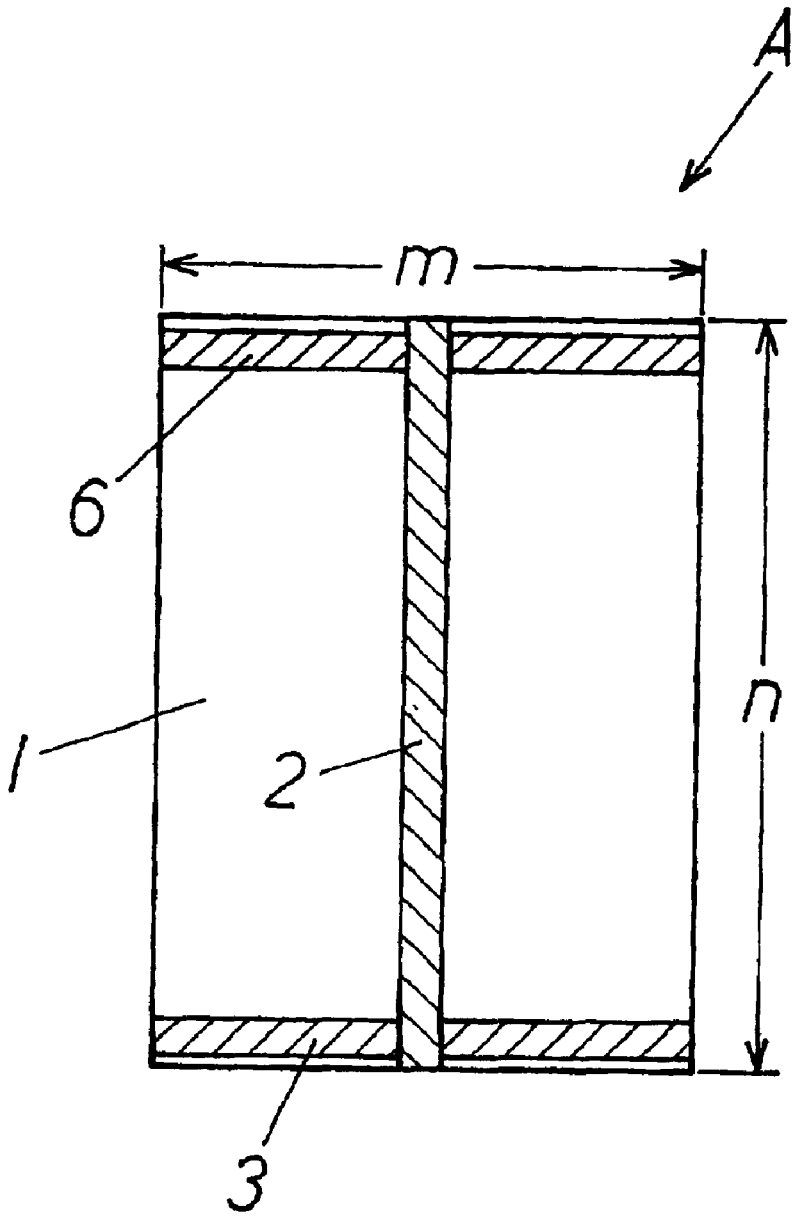
FIG. 2 is an elevation view showing a packaging body for heating processing in FIG. 1.
Figure 3:
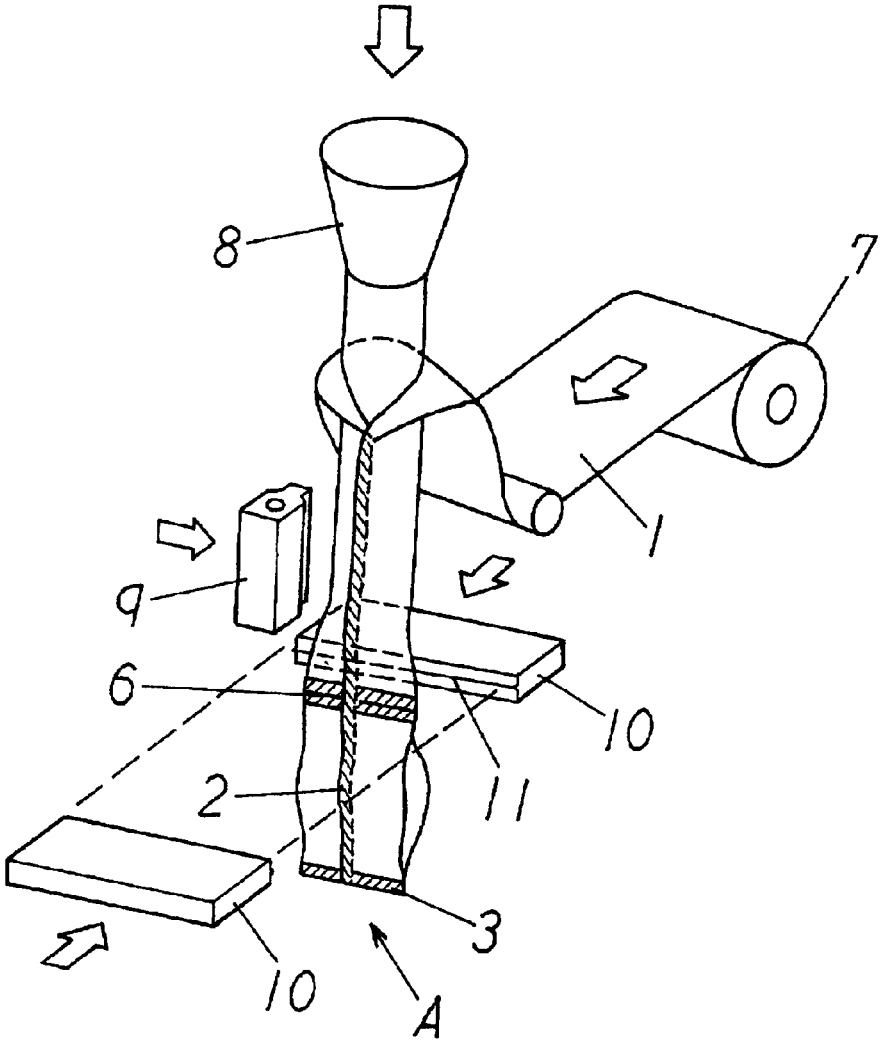
FIG. 3 is a perspective view showing one example in a state of fabricating a bag of a packaging body for heating processing in FIG. 1.

Then, the configuration of the packaging body for heating processing A in the first example is formed in a corniform rectangular shape as shown in FIG. 2 and provided so that the length ratio between its short side m and long side n is equal to m:n=1:1.1 or more.

It should be noted that if the length ratio between the relevant short side and long side is 1: less than 1.1 (that is, if it is a form similar to the square), there are some cases where a vapor communication action is done at a heat seal section of an optional position when the predetermined heating is given inside the bag, and a vapor communication at the vapor communication joining section 2 described later is not easily performed.

Then, in the configuration, as shown in FIG. 1(*a*), the both end sides 1*a* and 1*b* of a plastic film 1, that is, the relevant side surfaces (identical surfaces of the upper portion in FIG. 1(*a*)) are contacted with each other, a vapor communication joining section 2 is provided with a heat seal having a predetermined width and the film 1 is made in a cylindrical shape, then as shown in FIG. 1(*b*), the relevant cylindrical lower portion is made to be formed into a bag body 4 in a rafter roof shape by providing a bottom portion joining section 3 with a heat seal, after that, contents 5 are filled inside, an upper portion joining section 6 is formed with a heat seal in the foregoing cylindrical upper portion and it is made tightly sealed and packaged.

Moreover, besides the case where the packaging body A whose bag is fabricated in the afore-mentioned manner is used, as for this packaging body for heating processing A, there is also the case where it is filled with the contents 5 while the bag is fabricated, and tightly sealed and packaged (longitudinal pillow method and transverse pillow method), in this case, its both ends of the plastic film 1 which was fed in succession or intermittently from a wrapping material roll 7 are superposed respectively while it is wound on a input port for filling 8, the bottom is heat-sealed by a transverse seal bar 10 into a bag shape while this superposed portion is heat-sealed by a longitudinal seal bar 9 into a cylindrical shape, and it is filled with the contents from the input port for filling 8 into the inside of this cylindrical shape.

After filling the contents 5, the upper portion of the cylindrical bag is tightly heat-sealed by the foregoing transverse seal bar 10, then, the bottom portion of the next cylindrical bag is heat-sealed, and cut by a cutting blade 11 mounted on this transverse seal bar 10, thereby making up into a packaging body A into which the contents 5 is filled.

Figure 6:
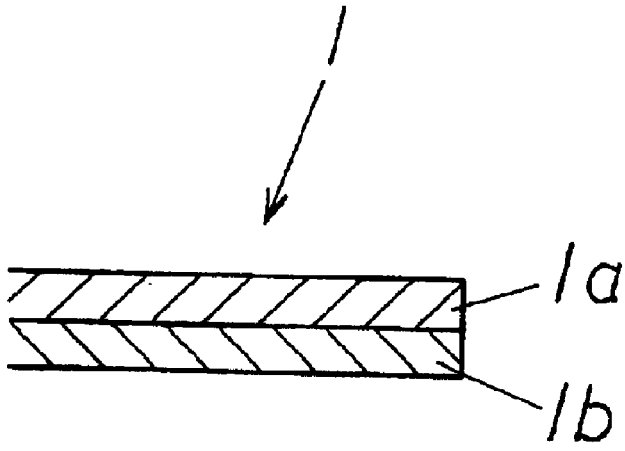
FIG. 6 is an illustration of a plastic film used for a packaging body for a heating processing in FIG. 1.

It should be noted that as shown in FIG. 6, the plastic film 1 afore-mentioned has a base material 1*a* and a sealant layer 1*b* on one side surface of the relevant base material 1*a*, the relevant base material 1*a* uses a plastic raw material having heat resistance to the heating of a microwave oven, for example, base materials such as biaxial stretching film, vinylidene chloride-acrylate ester based copolymer film, aluminium oxide vapor deposition biaxial stretching polyester film, polymetaxylene adipamide based polyamide stretching film (including laminated film co-extruded with 6-nylon) consisted of polypropylene and polyamide, polyester, ethylene-vinyl alcohol copolymer and the like are used.

Then, the sealant layer 1*b* afore-mentioned is a film highly dependent on the temperature, for example, a non-stretching polypropylene film based layer, it is preferably a co-extrusion multilayer type layer rather than a monolayer type layer.

As for the film highly dependent on the temperature referred to herein, since the force of peeling off during the usual condition (under the usual temperature not heated) is equal to or more than 3 kg f/15 mm, the tight sealing property of the contents is securely exhibited when it is heat-sealed, however, when the heating temperature at the time of cooking by heating achieves at 80° C.–90° C., it is preferably a film consisted of a seal portion being easily softened at the temperature of 90° C. and its force of peeling off is made to be lowered.

Moreover, the vapor communication joining section 2 afore-mentioned is to be a seal having an easily opening seal property, as shown in FIG. 1 and FIG. 2, is formed so that it is parallel to the longitudinal direction (n side direction) of the foregoing rectangularly shaped packaging body A and it is approximately nearby located at the position of the center section (may be shifted to the side of one side) and it is located on the upper surface side in the packaging body A at the time when the contents 5 is heat-processed.

Figure 4:
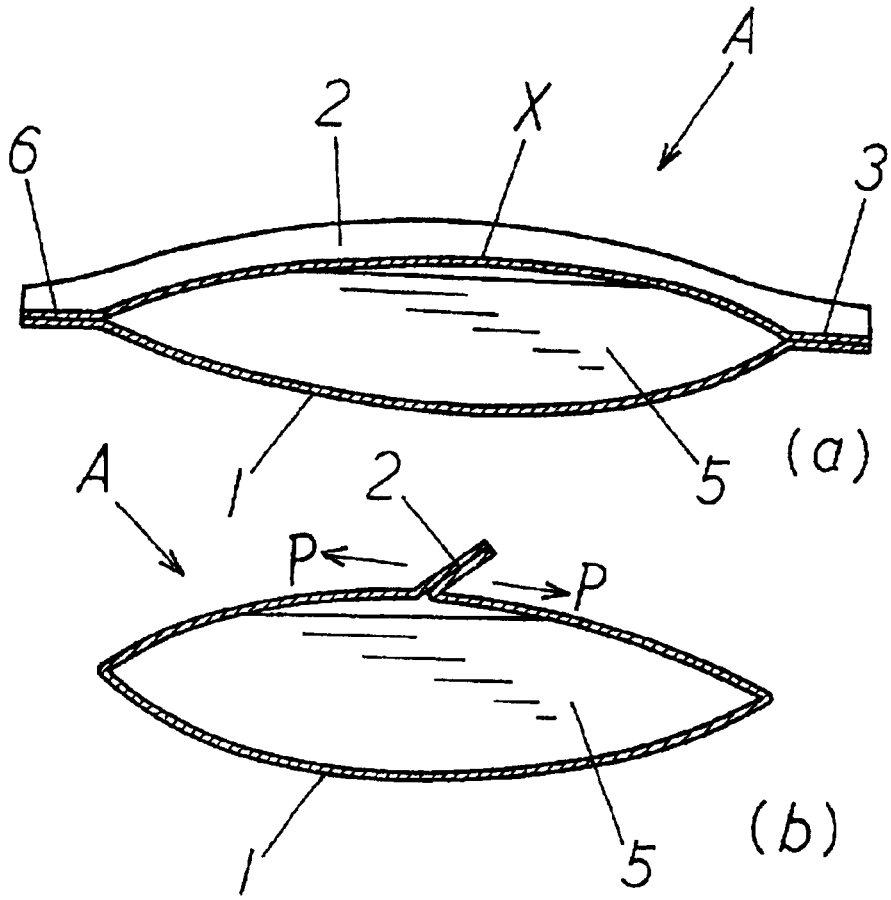
FIG. 4 is a longitudinal sectional view showing a heating condition of a packaging body for a heating processing in FIG. 1, FIG. 4(*a*) shows a sectional view taken along the direction of the longitudinal side and FIG. 4(*b*) shows a sectional view taken along the direction of the lateral side.

Specifically, by providing the vapor communication joining section 2 joining the both end sides 1*a* and 1*b* of the plastic film 1 in the longitudinal direction of the packaging body A, the whole length of the relevant vapor communication joining section 2 is extended as long as possible, since this vapor communication joining section 2 easily rises up by rising internal pressure when the contents 5 are heated as shown in FIG. 4 and makes the substantial expansion apex portion X in the packaging body A at which the pressure is apt to be added in the easiest manner when expansion occurs by heating initiate ha the peeling off at first, the joining of both end sides 1*a* and 1*b* is easily peeled off by a comparatively lower pressure and the vapor communication action is promoted.

Moreover, since the peeling off occurs at this apex portion x and vapor communication is initiated, after the contents 5 were cooled off, the vapor communication joining section 2 which rose up is tilted down to block the vapor communication section and the leakage of the contents 5 is prevented.

Particularly, as for a seal having an easily opening seal property of this vapor communication joining section 2, since its force of peeling off during the usual condition is equal to or more than 3 kg f/15 mm, the force of peeling off at the temperature of 90° C. ranges from 0 to 1,200 g f/15 mm as well as the tightly sealing property involving with the contents is securely exhibited, for example, when it is heated by a microwave oven, the internal pressure rose by the thermal expansion of the water vapor of the inside of the packaging body A, the internal air immediately peels off this vapor communication joining section 2, makes the pressure escape to the external, and does not cause the scattering of the contents by the burst of the bag due to the expanding pressure, and the inside of a microwave oven is not polluted.

In the case where the foregoing force of peeling off was equal to or more than 1,200 g f/15 mm, since the stable automatic vapor communication is not performed, expansion and then accidental burst occur at an inappropriate position of the packaging body A and there are some cases where the contents cannot only be eaten but also the inside of the microwave oven is polluted.

It should be noted that the strength for peeling off of the seal section in this vapor communication joining section 2 and other heat seal sections appropriately ranges from 0 to 1,200 gf/15 mm, and preferably ranges from about 100 to 800 gf/15 mm (where the strength for peeling off is a value measured at 300 mm/min. of stretching speed according to the test method of tightly sealing packaging bag/Z0238 (Japanese Industrial Standards) based on the food sanitary regulations).

Figure 5:
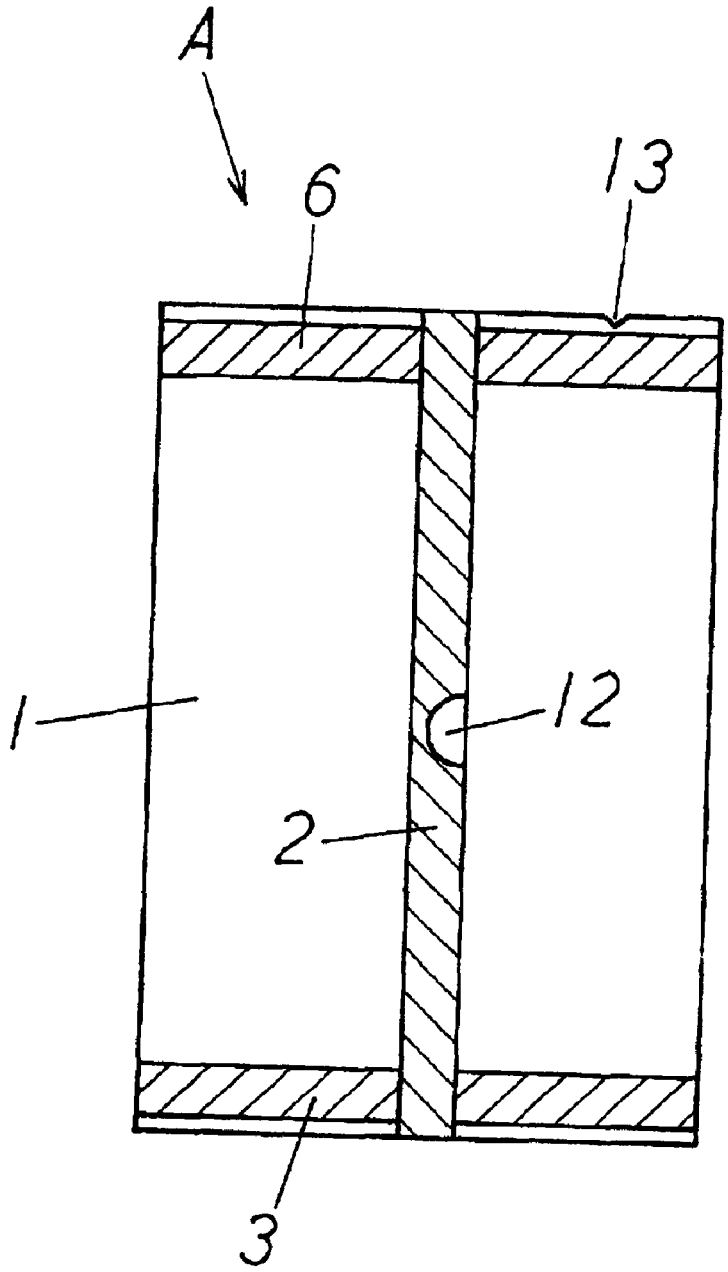
FIG. 5 is a front view showing another vapor communication joining section in FIG. 1.

Moreover, as shown in FIG. 5, in the vapor communication joining section 2, easily escaping pressure sections 12 of a non-sealed section such as semi-circular, triangular and rectangular shapes, a cutting away section and the like are formed at the position approximately located at the center section of the intermediate position of the entire length of the packaging body A in the width direction of the relevant vapor communication joining section 2 at the outer edge side, any of them is configured so that the peeling off of the vapor communication joining section 2 easily occurs and this pressure is rapidly gone when the desired internal pressure is achieved at the time of heating by narrowly forming the width of the vapor communication joining section 2 by the portions of these easily escaping pressure sections 12.

Furthermore, it may be provided by making the heat seal strengths of this vapor communication joining section 2 and the other heat seal sections 3 and 6 different, for example, means thereof is to change the heat seal temperature (the relevant heat seal temperature is set so that the temperature of the vapor communication joining section 2 is less than that of the other heat seal sections 3 and 6), and it may be a linear seal consisted of a plurality of pieces including one piece of the heat seal of the vapor communication joining section 2.

It should be noted that in FIG. 5, the reference numeral 13 denotes a notch for tearing at the time of opening of the packaging body A provided at the suitable position of the packaging body A, which is provided at the suitable position on the side of the short side in the relevant packaging body A, and the opening is obtained in parallel with the side of the long side in the packaging body A. This indicates that when the contents 5 is transferred to the container such as a dish or the like, if the packaging body A is turned upside down and opened from the relevant notch 13, the leakage of the contents 5 does not occur and the contents 5 can be easily taken out similarly to the case of three sided seal.

Next, using a complex film according to Example 1 and Example 2 of the present invention described later and Comparative Example 1 and Comparative Example 2, and employing the longitudinal pillow filling packaging machine made by Kawashima Machines, Co., Ltd., already cooked spaghetti was filled into the inside of the bag while the bag is fabricated at the filling speed of 60 bags per every minute and subsequently the relevant bag opening section was tightly sealed by heat-sealing and packaged.

Then, the respective already filled packaging bodies were heated for six minutes in a 500 W microwave oven made by Toshiba, Co., Ltd., and re-cooked spaghetti warmed to about 100° C. was made.

Hereinafter, the heat seal properties and the natural vapor communication properties during the heating of the packaging bodies of these Examples and Comparative Examples were tested for the purpose of the comparisons.

Example 1

Base material 1*a:*

Biaxial stretching polyamide film, 15 μm in thickness (Harden N1102, made by Toyobo, Co., Ltd.)

Sealant film 1*b:*

Random copolymerization polypropylene resin (Novatech FX-4, made by Nippon Polychem, Co., Ltd.), 35 μm in thickness, Random copolymearization polypropylene resin (Novatech FX-4, made by Nippon Polychem, Co., Ltd.), 60 wt %, ethylene-αolefin copolymerization resin (Tuffmer A 4085, made by Mitsui Chemical, Co., Ltd.) 20 wt %, metallocene linearly shaped, low density polyethylene (Kernel KC650, made by Nippon PolyChem, Co., Ltd.) 20 wt % blended one, 5 μm in thickness, are film-cast by co-extrusion using T die and sealant film, 40 μm in thickness was obtained.

Then, the base material 1*a* and the sealant film 1*b* were pasted together by a dry laminator and the complex plastic film 1 was prepared.

Example 2

Base material 1*a:*

Biaxial stretching polyamide film, 15 μm in thickness (Harden N1102, made by Toyobo, Co., Ltd.)

Sealant film 1*b:*

Random copolymerization polypropylene resin (Novatech FX-4, made by Nippon Polychem, Co., Ltd.), 35

μm in thickness, Random copolymearization polypropylene resin (Novatech FX-4, made by Nippon Polychem, Co., Ltd.), 60 wt %, propylene-αolefin copolymerization resin (Tuffmer XR1011T, made by Mitsui Chemical, Co., Ltd.), 20 wt %, metallocene linearly shaped low density polyethylene (Kernel KC650, made by Nippon PolyChem, Co., Ltd.) 20 wt %, blended one 5 μm in thickness are film-cast by co-extrusion using T die and sealant film 40 μm in thickness was obtained.

Then, the base material 1*a* and the sealant film 1*b* were pasted together by a dry laminator and the complex plastic film 1 was prepared.

Comparative Example 1

Base material:

Biaxial stretching polyamide film, 15 μm in thickness (Harden N1102, made by Toyobo, Co., Ltd.)

Sealant film:

Homopolypropylene film, 40 μm in thickness (Trephan NO 3301, made by Toray Synthesis, Co., Ltd.)

Comparative Example 2

Base material:

Biaxial stretching polyamide film, 15 μm in thickness (Harden N1102, made by Toyobo, Co., Ltd.)

Sealant film:

Random copolymerization polypropylene film, 40 μm in thickness (Trephan NO 3931, made by Toray Synthesis, Co., Ltd.)

Figure 7:
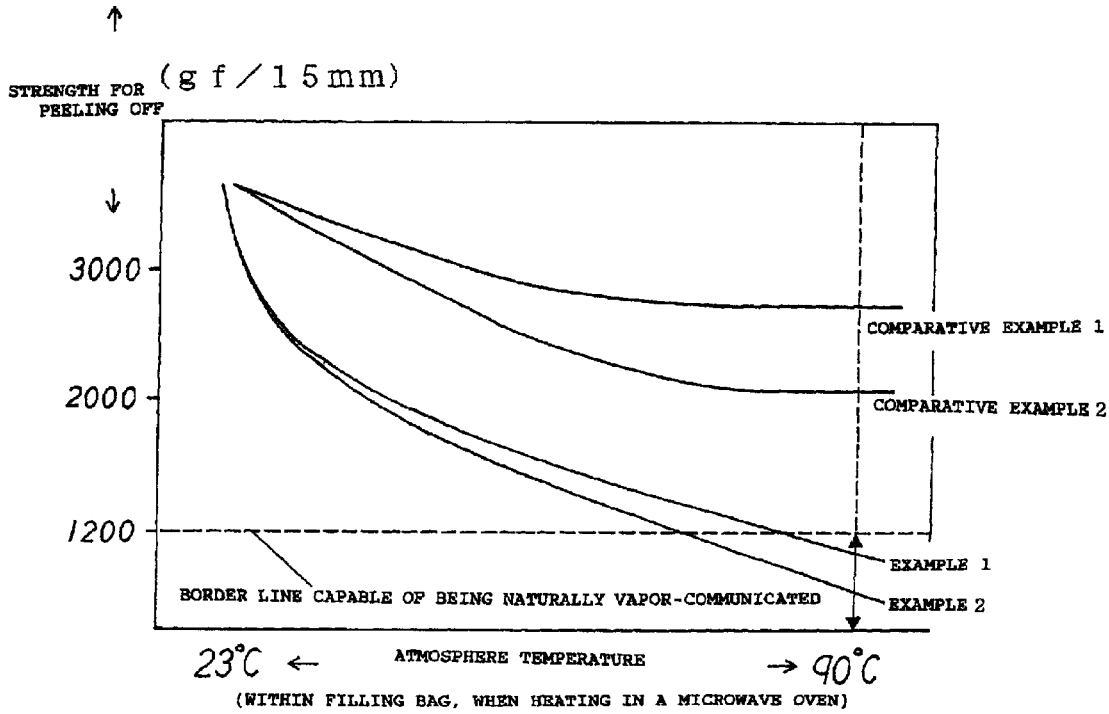
FIG. 7 is an illustration showing the results of a packaging body for heating processing of an example of the present invention and a comparative example of a conventional product.

According to these test results, as shown in the following Table 1 and FIG. 7, in both Example 1 and Example 2, the heat seal properties using the filling and packaging machine were good, and the tight sealing properties of the contents were securely exhibited during the usual condition.

Particularly, at the time of filling the contents into the bag, even if the heat seal of the heat seal section is performed in a state where the seasoning liquid of the spaghetti is attached to the relevant section as it is, since a sufficient heat seal strength is obtained by using a plastic film of Examples, the heat seal could be completed in a state where the contaminant of the heat seal section was extruded.

Particularly, at the time of heating processing using a microwave oven, specifically, when the temperature of the contents 5 and the packaging body A achieved at 90° C., since the strength for peeling off of the heat-sealed vapor communication joining section 2 is equal to or less than 1,200 g f/15 mm, the relevant vapor communication joining section 2 naturally was vapor-communicated and the internal water vapor and the like were gone to the external and the rising pressure within the packaging body A could be suppressed.

It should be noted that since the vapor communication joining section 2 is located on the upper surface side of the foregoing packaging body A at the time of heating processing of the contents 5 as shown in FIG. 4(*b*), the relevant vapor communication joining section 2 rose up by the internal pressure added within the relevant packaging body A, the force of peeling off was added to the direction of the arrow p shown in the same figure, FIG. 4(*b*) by the internal expansion and an escape of the pressure could be further easily done.

On the other hand, as shown in the following Table 1 and FIG. 7, in both Comparative Example 1 and Comparative Example 2, since the heat resistance and the heat seal initiation temperature were high, the width of the heat seal temperature was narrow, the heat seal property provided by the filling and packaging machine was not good, and the uneven sealing which has not been heat-sealed occurred.

Particularly, at the time of filling the contents into the bag, in the case where the foregoing contaminant is included in the heat seal section, further the heat seal property was lowered, the tight sealing property of the contents became incomplete and the commercial value has been lost.

Moreover, at the time of cooking by heating using a microwave oven, specifically even when the temperature of the contents and the packaging body achieved at 90° C., since the strength for peeling off of the heat seal section is the order of 2,000 g f/15 mm in Comparative Example 2, and still equal to or more than 2,700 g f/15 mm in Comparative Example 1, the relevant heat seal section could not only be naturally vapor-communicated, but also the internal pressure rose due to this, the packaging body burst, and the contents was scattered within the microwave oven.

TABLE 1

| | Heat seal property | Automatic vapor communication property in microwave oven |
|---|---|---|
| Example 1 | Good | Smoothly vapor-communicated |
| Example 2 | Good | Smoothly vapor-communicated |
| Comparative Example 1 | Slightly poor | Bag bursts |
| Comparative Example 2 | Good | Bag bursts |

Nest, the second example of a packaging body for heating processing A of the present invention will be described below. As for the configuration of the packaging body A for heating processing, in a packaging body for heating processing in which identical surface sides of the plastic film 1 are contacted with each other to form the bag by heat seals, and the vapor communication joining section 2 in a rafter roof shape is provided at one location of these heat seals, whereby contents 5 for heating processing are tightly sealed and packaged in the bag, in the vapor communication joining section 2, a film highly dependent on the temperature is intervened between the plastic films 1, and the relevant vapor communication joining section 2 is a seal having an easily opening seal property which is located on the upper surface side of the packaging body A at the time of heating processing of the contents 5 and makes the pressure escape to the external when the internal pressure of the packaging body A rises due to the heating.

Figure 8:
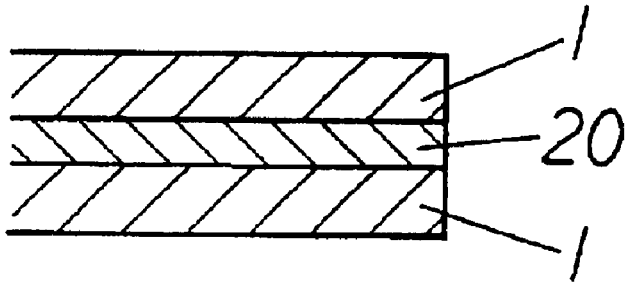
FIG. 8 is a sectional view showing the enlarged major parts of a packaging body for heating processing of the second example according to the present invention.

Specifically, as shown in FIG. 8, a film highly dependent on the temperature in the vapor communication joining section 2 is a tape 20 inserted between the plastic films 1.

As the materials of the tape 20, for example, polyolefinic resin such as polypropylene based resin, polyethylene based resin or polyester based resin is used.

Then, the force of peeling off during the usual condition is equal to or more than 3 kg f/15 mm, the force of peeling off of the seal having an easily opening seal property at the temperature of 90° C. ranges from 0 to 1,200 g f/15 mm and the property and action are exerted similarly to those of the foregoing first example.

It should be noted that the plastic film 1 is configured similarly to that of the foregoing first example, and as shown in FIG. 6, it has the base material 1*a* and the sealant layer 1*b* on one side surface of the base material 1*a*.

Figure 9:
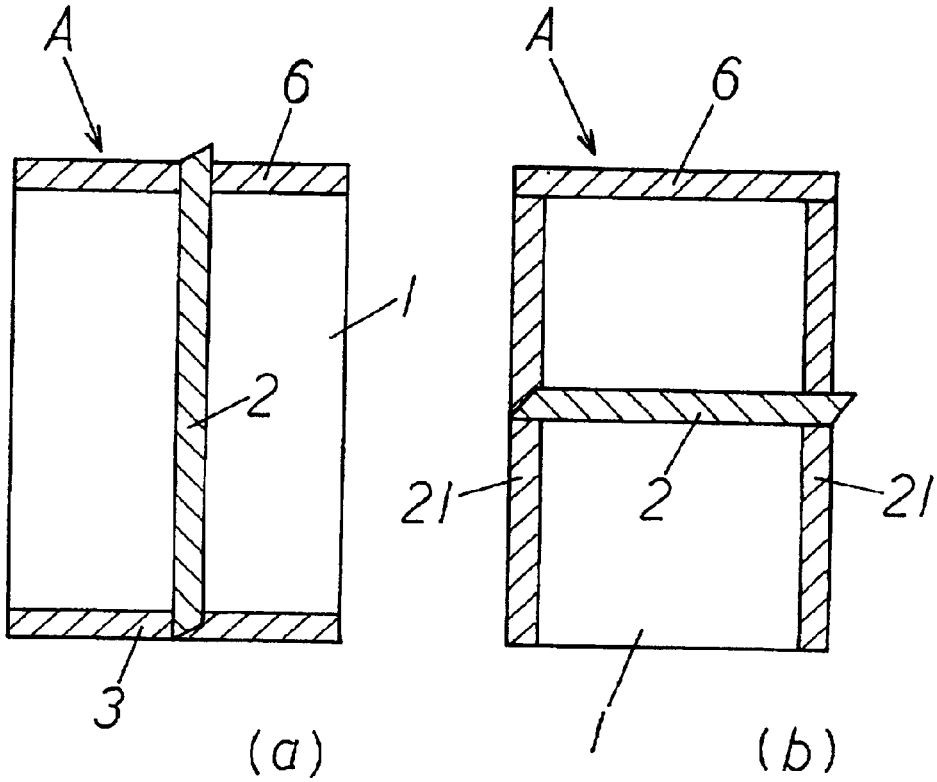
FIG. 9 is front views of the respective examples showing a vapor communication joining section of a packaging body for heating processing in FIG. 8.
Figure 10:
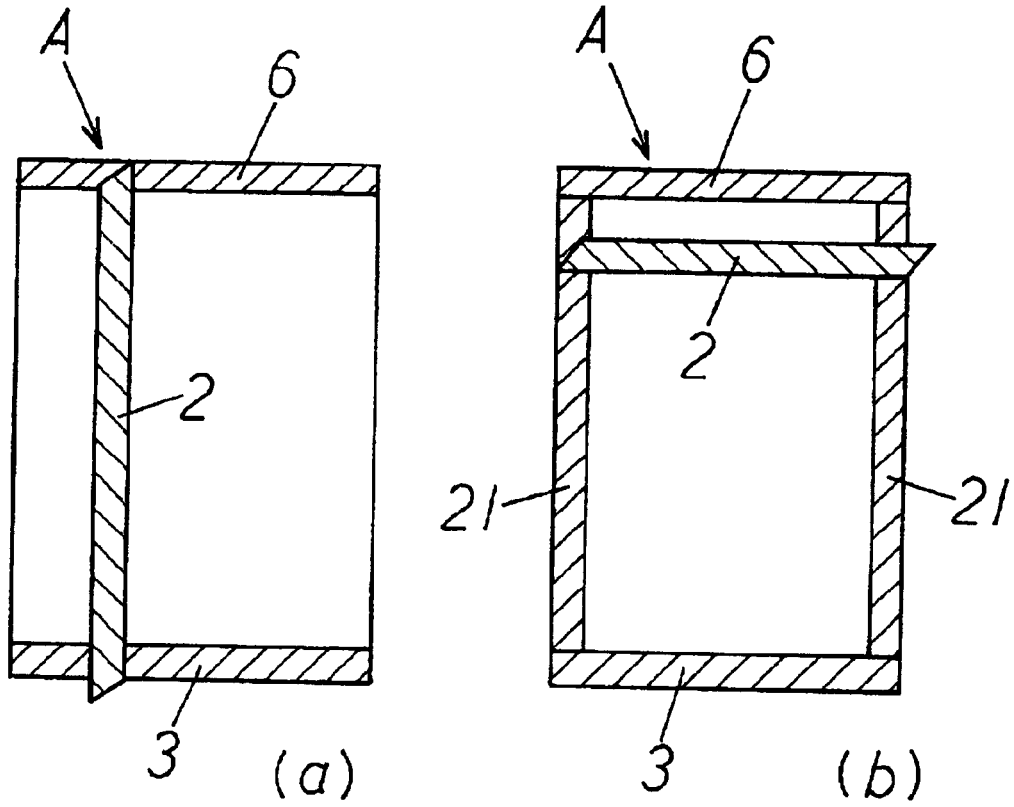
FIG. 10 is front views of the respective examples showing a mounting position of a vapor communication joining section of a packaging body for heating processing in FIG. 8.

Moreover, as to the configuration of the packaging body A, such as the longitudinal pillow method as shown in FIG. 9(*a*) or the traverse pillow method as shown in FIG. 9(*b*) or the like can be optionally selected, although the position of the vapor communication joining section 2 in a rafter roof shape is in general located at the center section, it may be configured so that the position is shifted to the right and left direction or upward and downward direction of the packaging body A by the portion of a predetermined distance as shown in FIG. 10. It should be noted that as shown in FIG. 9(*b*) and FIG. 10(*b*), the heat seal provided at the time of fabricating a bag is capable of being formed by providing side portion joining sections 21 and 21.

Figure 11:
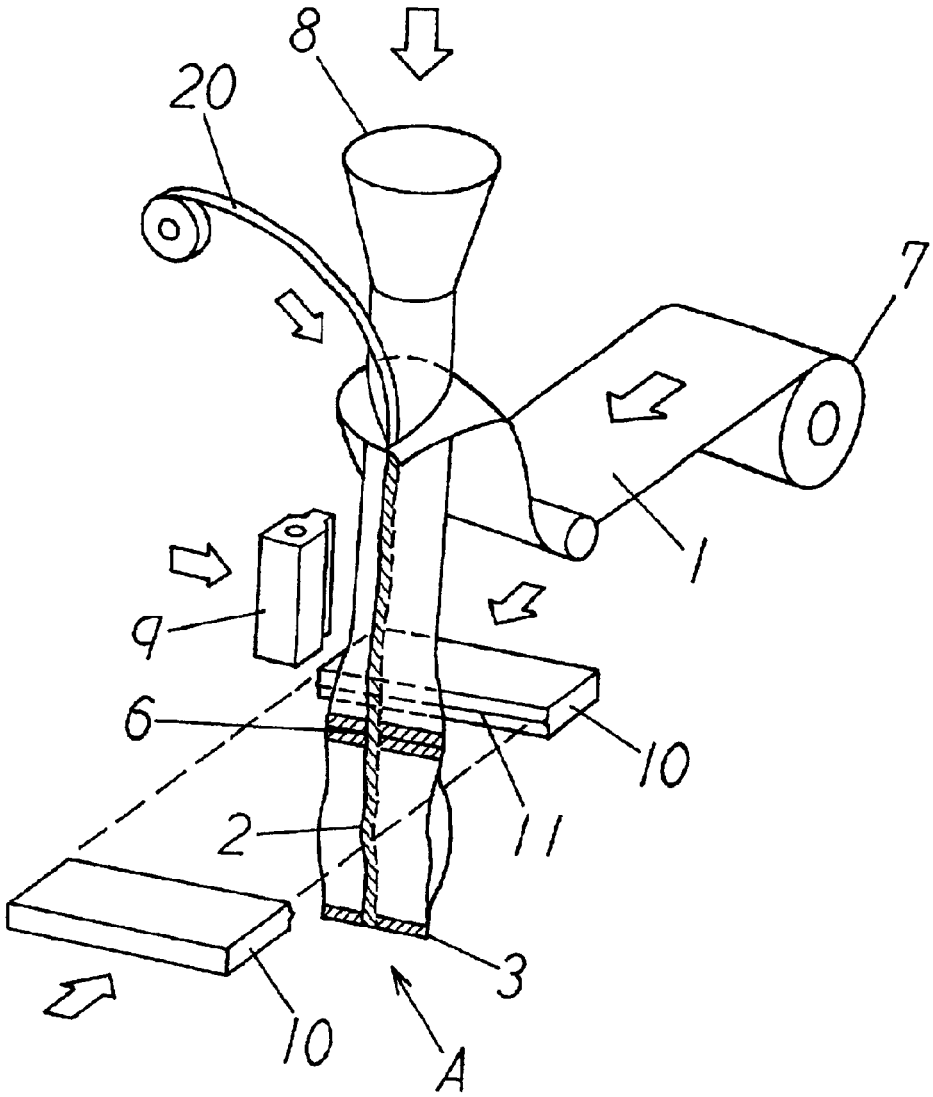
FIG. 11 is a perspective view showing one example in a state of fabricating a bag of a packaging body for heating processing in FIG. 8.

Then, upon fabricating this packaging body A, in the case where it is filled with the contents 5 while the bag is fabricated and tightly sealed and packaged (longitudinal pillow method and transverse pillow method), as shown in FIG. 11, both ends of the plastic film 1 are superposed respectively while the plastic film 1 which was fed in succession or intermittently from the wrapping material roll 7 is wound on the input port for filling 8.

On the other hand, the wound tape in a roll shape of the tape 20 has been previously suspended nearby the input port for filling 8, after the tape is inserted while the tape is fed so as to be tucked into the foregoing superposed portion, while the foregoing superposed plastic films 1 and the inserted tape 20 are heat-sealed into a cylindrical shape by the longitudinal seal bar 9, the bottom portion is heat-sealed into a bag shape by the transverse seal bar 10, and the contents are filled into the inside of this cylindrical shape from the input port for filling 8.

Figure 12:
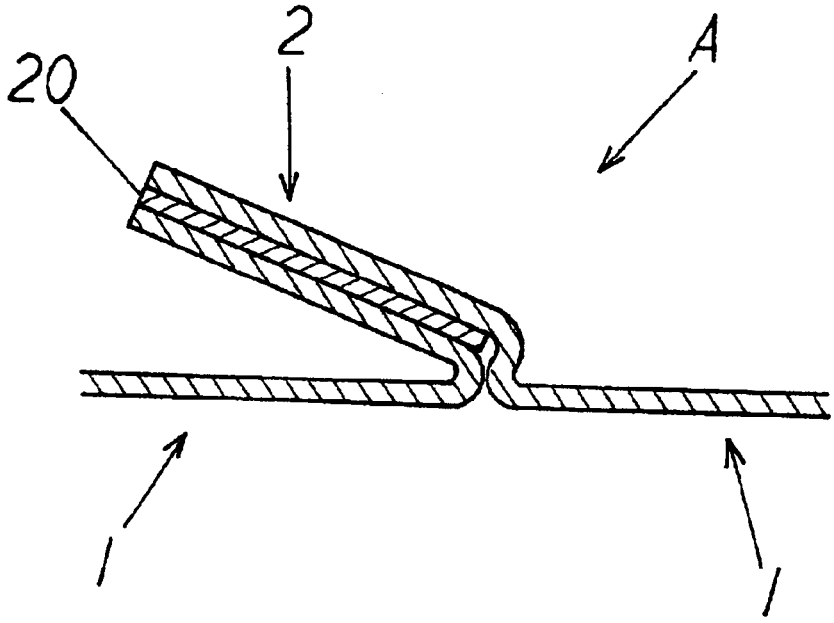
FIG. 12 is a section view showing an enlarged vapor communication joining section of a packaging body for heating processing in FIG. 11.

After filling the contents 5, while the upper portion of the cylindrical bag is tightly heat-sealed by the foregoing transverse seal bar 10, the bottom portion of the next cylindrical bag is subsequently heat-sealed and cut by the cutting blade 11 provided and attached on the transverse seal bar 10, thereby making up into a packaging body A into which the contents 5 have been filled. As shown in FIG. 12, in the vapor communication joining section 2 in a rafter roof shape, the tape 20 is inserted between the superposed plastic films 1 and the easily opening seal property is exerted by means of the tape 20 at the time of cooking the contents 5 by heating.

Next, using a complex film according to Example 3 and Example 4 of the present invention described later and Comparative Example 3 and Comparative Example 4, the heat seal properties and the natural vapor communication properties during the heating of the packaging body of these Examples 3 and 4 and Comparative Examples 3 and 4 were tested for the purpose of the comparisons under the conditions similar to those of the comparative test performed in the first example afore-mentioned.

Example 3

Plastic film 1 used for the bag body

Base material 1*a:*

Biaxial stretching polyamide film, 15 μm in thickness (Harden N1102, made by Toyobo, Co., Ltd.)

Sealant film 1*b:*

Random copolymerization polypropylene film, 50 μm in thickness (Trephan NO 3931, made by Toray Synthesis, Co., Ltd.)

Then, the base material 1*a* and sealant film 1*b* are pasted together by a dry laminator and the plastic film 1 used for the body of the bag was prepared.

Moreover, on the tape 20 inserted:

(1) Random copolymerization polypropylene resin (Novatech FX-4, made by Nippon Polychem, Co., Ltd.) 25 μm in thickness, random copolymerization polypropylene resin (Novatech FX-4, made by Nippon Polychem, Co., Ltd.) 60 wt %, ethylene-αolefin copolymerization resin (Tuffmer A 4085, made by Mitsui Chemical, Co., Ltd.) 20 wt %, metallocene linearly shaped, low density polyethylene (Kernel KC650, made by Nippon PolyChem, Co., Ltd.) 20 wt % blended one, 5 μm in thickness, are film cast by co-extrusion using T die and inserting tape 30 μm in thickness was obtained.

Now, the plastic film 1 was used, and as shown in FIG. 10(*b*), a deformed rafter roof shaped bag was prepared. At that time, while the inserting tape 20 of the configuration (1) in the foregoing Example 3 was tucked into the vapor communication joining section 2, the heat seal was performed.

Example 4

Plastic film 1 used for the bag body

Base material 1*a:*

Biaxial stretching polyamide film, 15 μm in thickness (Harden N1102, made by Toyobo, Co., Ltd.)

Sealant film 1*b:*

Random copolymerization polypropylene film, 50 μm in thickness (Trephan NO 3931, made by Toray Synthesis, Co., Ltd.)

Then, the base material 1*a* and sealant film 1*b* are pasted together by a dry laminator and the plastic film 1 used for the body of the bag was prepared.

Moreover, on the tape 20 inserted:

(2) Random copolymerization polypropylene resin (Novatech FX-4, made by Nippon Polychem, Co., Ltd.) 25 μm in thickness, random copolymerization polypropylene resin (Novatech FX-4, made by Nippon Polychem, Co., Ltd.) 60 wt %, propylene-αolefin copolymerization resin (Tuffmer XR1011T, made by Mitsui Chemical, Co., Ltd.) 20 wt %, metallocene linearly shaped, low density polyethylene (Kernel KC650, made by Nippon PolyChem, Co., Ltd.) 20 wt % blended one 5 μm thickness are film cast by co-extrusion using T die and inserting tape 30 μm in thickness was obtained.

Now, the plastic film 1 was used, and as shown in FIG. 10(*b*), a deformed rafter roof shaped bag was prepared. At that time, while the inserting tape 20 of the configuration (2) in the foregoing Example 4 was tucked into the vapor communication joining section 2, the heat seal was performed.

Comparative Example 3

Bag body film

Base material:

Biaxial stretching polyamide film, 15 μm in thickness (Harden N1102, made by Toyobo, Co., Ltd.)

Sealant film:

Random copolymerization polypropylene film, 50 μm in thickness (Trephan NO 3931, made by Toray Synthesis, Co., Ltd.)

Then, the bag body film was prepared by pasting the base material and sealant film together using a dry laminator and as shown in FIG. 10(*b*), a deformed rafter roof shaped bag was prepared using this bag body film.

Comparative Example 4

Bag body film

Base material:

Biaxial stretching polyamide film, 15 μm in thickness (Harden N1102, made by Toyobo, Co., Ltd.)

Sealant film:

Random copolymerization polypropylene film, 50 μm in thickness (Trephan NO 3931, made by Toray Synthesis, Co., Ltd.)

Then, the bag body film was prepared by pasting the base material and sealant film together using a dry laminator and as shown in FIG. 10(*b*), a deformed rafter roof shaped bag was prepared using this bag body film.

According to the results of these tests, the results similar to the results of the comparative test performed in the foregoing Example 1 were obtained, in both Example 3 and Example 4, the tightly sealing property of the contents was securely exhibited during the usual condition and at the time of cooking by heating using a microwave oven, specifically when the temperature of the contents 5 and the packaging body A achieved at 90° C., since the strength for peeling off of the heat-sealed vapor communication joining section 2 is equal to or less than 1,200 g f/15 mm, the relevant vapor communication joining section 2 was naturally vapor-communicated and the internal water vapor and the like were gone to the external and the rising pressure within the packaging body A could be suppressed as shown in following table 2.

TABLE 2

| | Automatic vapor communication property in microwave oven |
|---|---|
| Example 1 | Smoothly vapor-communicated |
| Example 2 | Smoothly vapor-communicated |
| Comparative Example 1 | Bag bursts |
| Comparative Example 2 | Bag bursts |

The present invention configured as described above can provide a packaging body into which the food or the like is filled, wherein the burst of the packaging body by the rising pressure due to the heating of the inside can be provided and the contents such as food or the like contained in a package as it is can be cooked by heating using a microwave oven.

Particularly, the configuration of a packaging body of the present invention is simple, and in addition, upon a fabricating a bag or a filling the contents and tightly sealing and packaging, such peculiar effects as that the manufacturing cost is lowered and the packaging foods or the like can be provided in the market in a lower price are exerted.

It will also be appreciated that, although a limited number examples of the invention have been described in detail for the purposes of illustration, various modifications may be made without departing from the spirit and scope of the invention. Accordingly, the invention should not be limited except as by the appended claims.

What is claimed is:

1. A packaging body for heat processing a material retained therein, comprising:

a plastic base material having side joining sections, and end sides, said side joining sections and end sides being superposed and connected together to form a bag for filling the material therein, and a sealant layer interposed between the end sides to connect the end sides together therethrough to thereby form a vapor communication joining section at the end sides, said sealant layer providing a peeling off property from 0 to 1,200 gf/15 mm at 90° C. and a peeling off property of equal to or more than 3 kgf/15 mm at 23° C. so that only when the packaging body is heated more than 90° C., the vapor communication joining section is only opened to release pressure inside the packaging body.

2. A packaging body according to claim 1, wherein said side joining sections are firmly connected together when the packaging body is heated more than 90° C.

3. A packaging body according to claim 2, wherein said sealant layer is formed of a non-stretching polypropylene film.

4. A packaging body according to claim 3, wherein said bag has an elongated rectangular shape, said vapor communication joining section being formed parallel to a longitudinal direction of the bag.

5. A packaging body according to claim 4, wherein said sealant layer is deposited integrally on an entire surface of the plastic base material.

6. A packaging body according to claim 3, wherein said sealant layer is a tape interposed between the side joining sections of the plastic base material to join the side joining sections.

* * * * *